United States Patent [19]

Thorogood et al.

[11] Patent Number: 4,869,742

[45] Date of Patent: Sep. 26, 1989

[54] AIR SEPARATION PROCESS WITH WASTE RECYCLE FOR NITROGEN AND OXYGEN PRODUCTION

[75] Inventors: Robert M. Thorogood; Thomas M. Roden, both of Macungie, Pa.

[73] Assignee: Air Products and Chemicals, Inc., Allentown, Pa.

[21] Appl. No.: 254,509

[22] Filed: Oct. 6, 1988

[51] Int. Cl.[4] ..... F25J 3/02

[52] U.S. Cl. ..... 62/32; 62/39; 62/42; 62/44

[58] Field of Search ..... 62/11, 13, 18, 38, 39, 62/42, 44, 32

[56] References Cited

U.S. PATENT DOCUMENTS

| | | | |
|---|---|---|---|
| 3,210,951 | 10/1965 | Gaumer | 62/29 |
| 3,277,655 | 10/1966 | Geist et al. | 62/29 |
| 3,327,489 | 6/1967 | Gaumer | 62/29 |
| 3,754,406 | 8/1973 | Allam | 62/41 |
| 4,222,756 | 9/1980 | Thorogood | 62/13 |
| 4,372,764 | 2/1983 | Theobald | 62/13 |
| 4,453,957 | 6/1984 | Pahade et al. | 62/25 |
| 4,464,188 | 8/1984 | Agrawal et al. | 62/30 |
| 4,464,191 | 8/1984 | Erickson | 62/31 |
| 4,617,036 | 10/1986 | Suchdeo et al. | 62/11 |
| 4,702,757 | 10/1987 | Kleinberg | 62/24 |
| 4,704,147 | 11/1987 | Kleinberg | 62/24 |
| 4,704,148 | 11/1984 | Kleinberg | 62/24 |

OTHER PUBLICATIONS

L. Celar, et al., "Flexible Process of Pressure Nitrogen and Low Pressure Oxygen Production".

*Primary Examiner*—Ronald C. Capossela
*Attorney, Agent, or Firm*—Willard Jones, II; James C. Simmons; William F. Marsh

[57] ABSTRACT

The present invention is an improved process for the production of nitrogen and oxygen that uses a double distillation column arrangement. The improvement to the process is the recycling of at least a portion of the oxygen-enriched waste stream to the bottom of the high pressure column. As a result of this improvement, the process is capable of making a nitrogen product with high purity (e.g., 5 ppm oxygen product) at high pressures (e.g., 40 to 150 psia) while simultaneously producing high purity oxygen (e.g., 99.6% oxygen). Nitrogen is produced only from the high pressure column.

4 Claims, 5 Drawing Sheets

AIR SEPARATION PROCESS WITH WASTE RECYCLE FOR NITROGEN AND OXYGEN PRODUCTION

TECHNICAL FIELD

The present invention relates to a process for the separation of air into its constituent components by cryogenic distillation.

BACKGROUND OF THE INVENTION

Numerous process for the separation of air into its constituent components are known in the art, among these are the following:

U.S. Pat. No. 3,210,951 discloses a fractionation cycle employing first and second fractionating zones operating under different pressures and including two reboiler/condensers. Both of the reboiler/condensers are interconnected with the stages of fractionation in such a manner as to effect the required reboil and reflux production with minimum pressure differential between the stages of rectification and also decreased the irreversibility of the overall fractionation process thereby obtaining the desired separation with the high pressure stage operating under substantially reduced pressure.

U.S. Pat. No. 3,277,655 discloses an improvement to the fractionation process taught in U.S. Pat. No. 3,210,951. In this process, the heat exchange occurring in one of the two reboiler/condensers between the bottoms liquid from the lower pressure column and the gaseous material from the high pressure column results in complete vaporization of the liquid from the low pressure column thereby satisfying the reboiler requirements of the low pressure column. Additionally, when the liquefied gaseous material from the high pressure column is introduced into the lower pressure column it improves the reflux ratio in the upper portion of the low pressure column which increases the separation efficiency and makes it possible to lower the pressure of the gaseous mixture entering the cycle.

U.S. Pat. No. 3,327,489 discloses another improvement to U.S. Pat. No. 3,210,951 to lower the pressure in the high pressure fractionator. In the process, the pressure reduction is obtained along with the associated power reduction by establishing a heat exchange between gaseous material, which may comprise the feed mixture, and a liquid component collecting in the bottom of the low pressure fractionator, with the liquid component being under different pressure.

U.S. Pat. No. 3,754,406 discloses a process for the production of low purity oxygen, in which a low pressure stream of incoming air is cooled against outgoing gas streams and fed into a high pressure distillation column. A high pressure stream of incoming air is cooled against outgoing gas streams, partially condensed against boiling oxygen product in a product vaporizer, and separated into gas and liquid streams. The liquid stream being subcooled and expanded into a low pressure fractionating column. The gas stream is reheated and expanded to provide process refrigeration and is introduced into the low pressure fractionating column. Crude liquid oxygen from the bottom of the high pressure column is cooled and introduced into the low pressure column after being used to liquefy some of the nitrogen from the high pressure column in an external reboiler condenser. Liquid oxygen product from the low pressure column is pumped to a higher pressure before being passed to the subcooler and the product vaporizer. The remainder of the high pressure nitrogen is liquefied in a second external reboiler/condenser and is used as reflux for the two columns. A waste nitrogen stream is removed from the low pressure column.

U.S. Pat. No. 4,222,756 discloses a process in which a two pressure distillation column is used in which both pressurized column sections are refluxed with a nitrogen-enriched stream. The low pressure column is fed by an oxygen-enriched stream from the high pressure column which is expanded to reduce its pressure and temperature.

U.S. Pat. No. 4,453,957 discloses a cryogenic process to efficiently produce large quanties of nitrogen at elevated pressure by use of a double column and multiple condenser-reboilers.

U.S. Pat. No. 4,464,188 discloses a process and apparatus for the separation of air by cryogenic distillation in a rectification column using two nitrogen recycle streams and a sidestream of the feed air stream to reboil the column. One of the nitrogen recycle streams is expanded to provide refrigeration and to provide power to compress the feed air sidestream.

U.S. Pat. No. 4,617,036 discloses a process for the cryogenic distillation of air to recover nitrogen in large quantities and at relatively high pressure, wherein a portion of the nitrogen reflux for the distillation is achieved by heat exchanging nitrogen gas in a side reboiler against waste oxygen at reduced pressure.

U.S. Pat. No. 4,702,757 discloses a process utilizing high and low pressure distillation columns for the production of an oxygen-enriched air product. Feed air is fed to the main heat exchangers at two pressures. The high pressure feed air from the main exchanger is used to supply refrigeration, by expanding a portion of the high pressure air prior to introducing that portion into an intermediate location in the low pressure column, and to vaporize the oxygen-enriched air product prior to using the stream as reflux for the high pressure column. The low pressure feed air from the main heat exchangers is partially condensed to supply reboiler duty to a low pressure column and is then fed to a high pressure column. The high pressure column condenser is used to reboil an intermediate liquid in the low pressure column.

U.S. Pat. No. 4,704,147 discloses a process for the production of an oxygen-enriched air product, feed air is fed to the main heat exchangers at two pressures. The high pressure feed air from the main exchanger is partially condensed to vaporize the oxygen-enriched air product. This partially condensed feed air is separated with the vapor phase being warmed and expanded to supply refrigeration and subsequently being fed to the low pressure fractionation section, and the liquid phase being used to reflux both the high pressure and low pressure fractionation sections of a double distillation column. The low pressure feed air from the main heat exchangers is fed to the high pressure fractionation section. The high pressure fractionation section condenser is used to provide reboiler duty to the low pressure fractionation section.

U.S. Pat. No. 4,704,148 discloses a process utilizing high and low pressure distillation columns, for the separation of air to produce low purity oxygen and waste nitrogen streams. Feed air from the cold end of the main heat exchangers is used to reboil a low pressure distillation column and to vaporize the low purity oxygen product. This heat duty for column reboil and product vaporization is supplied by splitting the air feed into at least three substreams. One of the substreams is totally condensed and used to provide reflux to both the low pressure and high pressure distillation column, preferably the substream which is fed to the oxygen vaporizer, while a second substream is partially condensed with the vapor portion of the partially condensed substream being fed to the bottom of the high pressure distillation column and the liquid portion providing reflux to the low pressure column. The third substream is expanded to recover refrigeration and then introduced to the low pressure column as column feed. Additionally, the high pressure column condenser is used as an intermediate reboiler in the low pressure column.

Patent Application U.S. Ser. No. 07/132,534 filed Dec. 14, 1987, now U.S. Pat. No. 4,738,210 discloses a process to produce large quantities of pure nitrogen and small amounts of high purity oxygen co-product which utilizes a modified single distillation column nitrogen generator. The modification is the addition of a small second column which purifies a portion of the oxygen enriched liquid from the nitrogen generator overhead condenser. Reboiling for the second column is provided by condensing part of the nitrogen overhead from the nitrogen generator. This condensed nitrogen is used as reflux in the nitrogen generator.

SUMMARY OF THE INVENTION

The present invention is an improvement to a process for the separation of air into its constituent components by cryogenic distillation using a double distillation column having a high pressure column and a low pressure column. In the process, a feed air stream is compressed, cooled to near to the dew point of the feed air stream, fed to the high pressure column, wherein it is distilled to produce a gaseous nitrogen stream as overhead and an oxygen-enriched bottoms liquid. The oxygen-rich bottoms liquid from the high pressure column is rectified in the low pressure column producing a gaseous oxygen stream and an oxygen-enriched waste stream as overhead. The improvement to the process for producing a high purity, high pressure, nitrogen product while simultaneously producing high purity oxygen product comprises recycling at least a portion of the oxygen-enriched waste stream removed as overhead from the low pressure column back to the bottom of the high pressure column.

Refrigeration for the process can be provided by at least three means: (1) compressing and expanding at least a portion of the oxygen-enriched waste stream prior to recycle back to the bottom of the high pressure column; (2) expanding at least a portion of the gaseous nitrogen stream removed as overhead from the high pressure column prior to removal from the process as product; and (3) further compressing and expanding at least a portion of the compressed feed air stream prior to introducing the feed air to the high pressure column.

DETAILED DESCRIPTION OF THE INVENTIONS

The conventional double column distillation process for simultaneous oxygen and nitrogen production produces most of its nitrogen product at low pressure and cannot be efficiently operated at a nitrogen to oxygen product ratio above about 3.5. A need exists for an improved process to simultaneously produce oxygen with high pressure nitrogen at a reduced oxygen power consumption.

The process of the present invention is an improved air separation process for gaseous nitrogen (GAN) and gaseous oxygen (GOX) production that uses a double distillation column arrangement in which a portion of the waste stream is recycled to the bottom of the high pressure column. The process produces high purity GAN at pressure and with high recovery simultaneously with GOX production. The produced GOX can be produced as part or all of the total oxygen reject stream and at a purity dependent upon recycle flow and oxygen recovery.

The process differs from a single column nitrogen generator by the addition of oxygen-enriched waste recycle and the addition of a few stages below the air feed to the high pressure column and above the overhead reboiler condenser. A single section low pressure column is thus formed in which there is only one feed stream and no production of nitrogen. Both product streams from the low pressure column contain more oxygen than the air feed.

Figure 1:
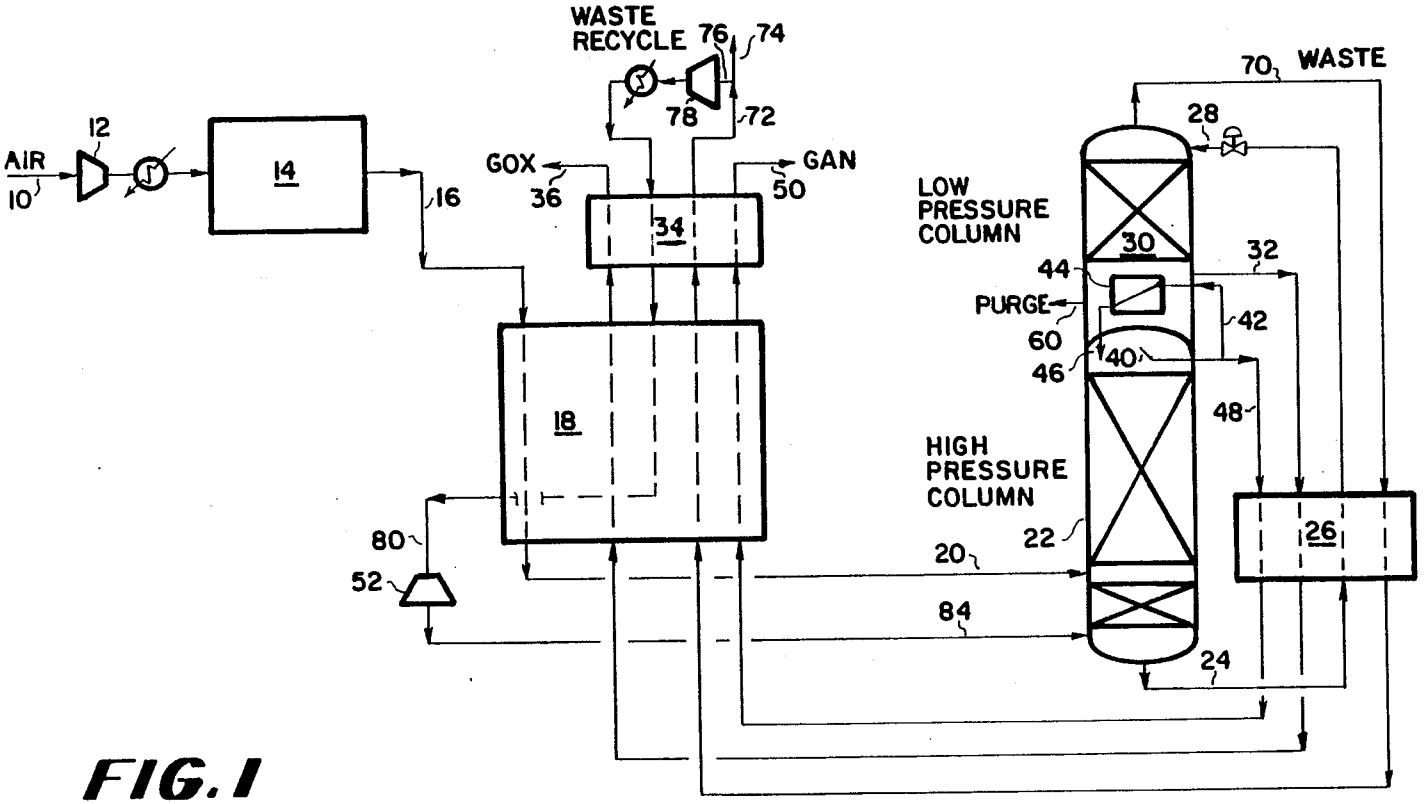
FIG. 1 is a schematic diagram of a first embodiment of the present invention.
Figure 2:
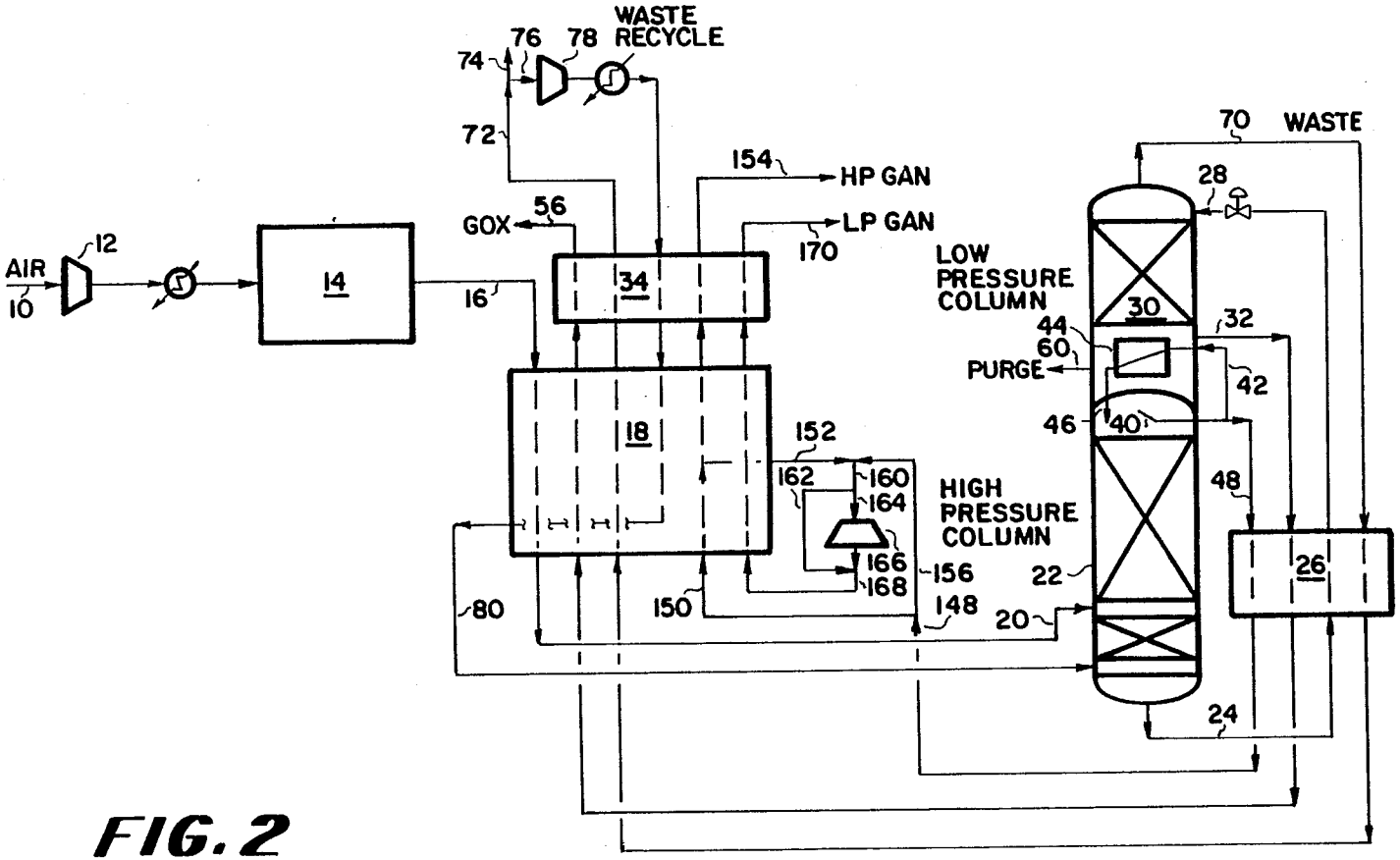
FIG. 2 is a schematic diagram of a second embodiment of the present invention.
Figure 3:
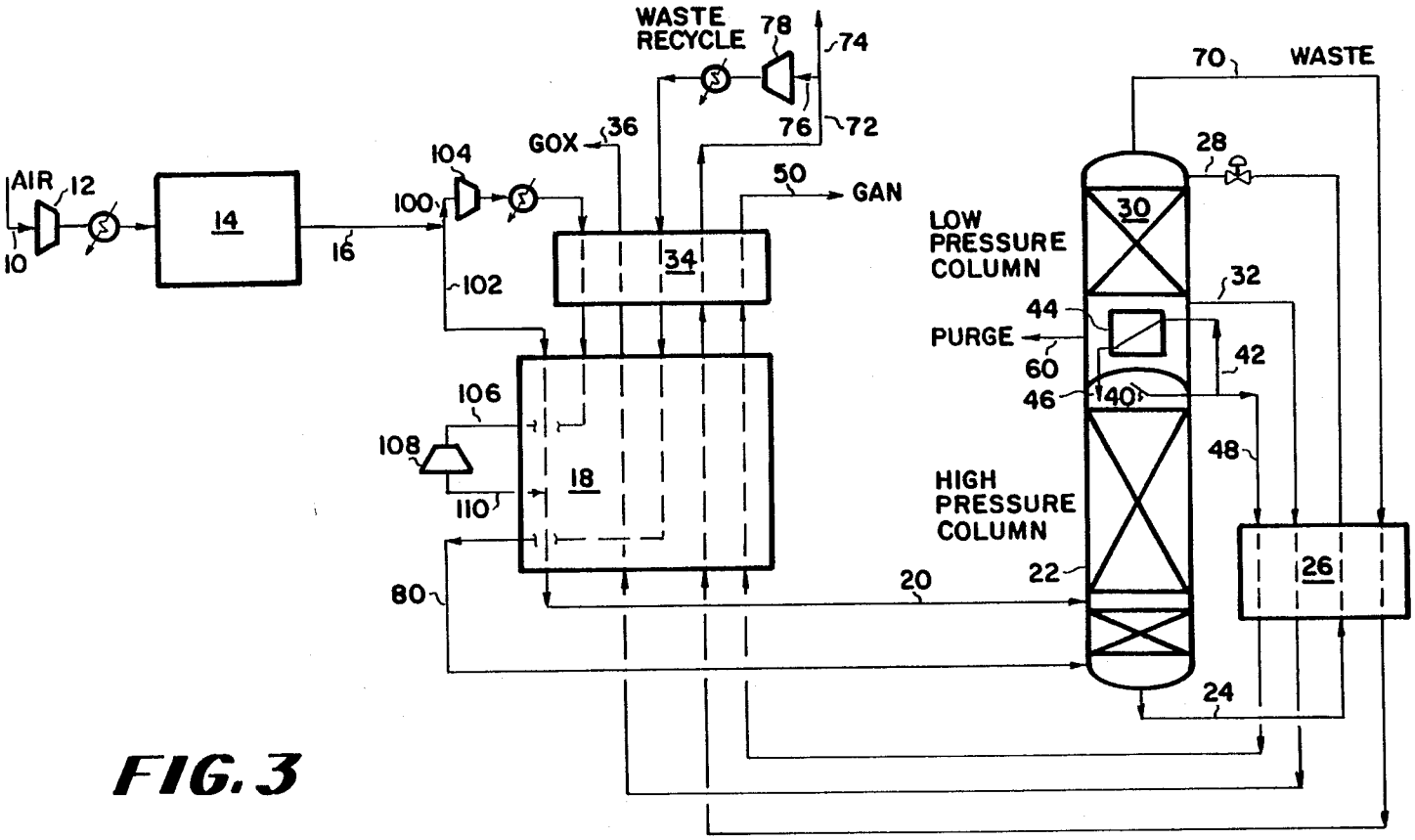
FIG. 3 is a schematic diagram of a third embodiment of the present invention.

The double column process of the present invention can utilize most any scheme for the provision of refrigeration. Three embodiments of the present invention using varying sources of refrigeration are shown in FIGS. 1, 2 and 3. FIGS. 1, 2 and 3 use the same identifying number for common elements in the embodiments.

With reference to FIG. 1, which utilizes waste stream-expansion to provide refrigeration, a feed air stream is introduced to the process via line 10, compressed in compressor 12, aftercooled with typically a water or air cooler, and processed to remove any contaminants which would freeze at cryogenic temperatures (e.g., water and carbon dioxide). The processing to remove water and carbon dioxide can be any of the known processes, such as a mole sieve adsorption unit. This compressed, contaminant-free air, now in line 16, is cooled to near its dew point and fed to a lower-intermediate location of high pressure distillation column 22, via line 20, wherein it is separated into a nitrogen overhead and an oxygen-enriched bottoms liquid.

The nitrogen overhead of high pressure distillation column 22 is removed via line 40 and split into two portions. A first portion, in line 42, is fed to and condensed in reboiler/condenser 44 located in the bottoms sump of low pressure distillation column 30 against boiling oxygen and then returned to the top of high pressure distillation column 22 as reflux. A second portion, in line 48, is warmed in heat exchangers 26, 18 and 34 to recover refrigeration and removed as gaseous nitrogen product via line 50.

The oxygen-enriched bottoms liquid is removed from high pressure distillation column 22 via line 24, subcooled in heat exchanger 26, reduced in pressure and fed to the top of low pressure distillation column 30. In low pressure distillation column 30, the super-cooled, reduced pressure, oxygen-enriched bottoms liquid from high pressure column 22 is rectified producing an oxygen-rich waste stream as overhead and an oxygen product stream as bottoms.

The oxygen product stream is removed, via line 32, from low pressure distillation column 30 at a location below the lowest tray and above the outlet of reboiler/-condenser 44. This gaseous oxygen stream is then warmed in heat exchangers 26, 18 and 34 to recover refrigeration and removed as gaseous oxygen product via line 36.

The oxygen-rich waste stream from low pressure distillation column 30 is removed via line 70 and is warmed in heat exchangers 26, 18 and 34 to recover refrigeration. Since FIG. 1 depicts the process expanding the waste stream to provide refrigeration for the process, the warmed oxygen-rich waste stream, in line 72, is split into two portions. A first portion , in line 74, in order to balance the recycle of the waste stream back to the high pressure distillation column 30, is removed from the process as waste. A second portion (and major portion), in line 76, is compressed by compressor 78, after-cooled by a cooling water heat exchanger and cooled in heat exchangers 34 and 18. This cooled oxygen-rich waste recycle stream, in line 80, is expanded thereby recovering power and fed to the bottom of high pressure distillation column 22.

The second embodiment of the process of the present invention expanding the nitrogen product stream for the provision of refrigeration is depicted in FIG. 2. With reference to FIG. 2, one can see that the bulk of the process is the same as in FIG. 1, with two exceptions. First, the waste stream, in line 76, is not compressed to as high a pressure, and the compressed waste stream, in line 80, is not expanded but is directly fed to the bottom of high pressure distillation column 22. Second, the second portion of the nitrogen overhead, in line 48, is warmed in heat exchanger 26 and is then split into two substreams. The flow rate in each of the two substreams is such as to balance the refrigeration requirements of the process. The first portion is fed to heat exchanger 18 via line 150 wherein it is warmed to recover refrigeration. The second portion is combined via line 156 with the warmed first portion in line 152 to form line 160. This recombined stream in line 160 is then split into two parts, again to balance the refrigeration requirements of the process. The first part in line 164 is expanded in expander 166 and then recombined with the second portion in line 162 to form an expanded waste stream in line 168. This expanded waste stream is then fed to and warmed in heat exchangers 18 and 34 to provide refrigeration and is then removed from the process as nitrogen product via line 170.

The third embodiment, which is depicted in FIG. 3 and uses feed air expansion for the provision of refrigeration, is like the second embodiment very similar to the first embodiment (FIG. 1) with a few exceptions. First, the compressed feed air stream, in line 16, is split into two portions. A first portion, in line 100, is further compressed in compressor 104, after cooled with a cooling water heat exchanger and further cooled in heat exchanger 18. This cooled, further compressed, first portion of the feed air stream, in line 106, is expanded in expander 108 to provide refrigeration and united with a second portion of the feed air stream, in line 102, via line 110, to form line 20. This recombined feed air stream, in line 20, is cooled in heat exchanger 18 and then introduced to a lower intermediate location of high pressure distillation column 22. Second, the waste stream, in line 76, is not compressed to as high a pressure, and the compressed waste stream, in line 80, is not expanded but is directly fed to the bottom of high pressure distillation column 22.

In order to demonstrate the efficacy of the process of the present invention, the embodiments depicted in FIGS. 1 and 2 were computer simulated and evaluated. The following are the results of these evaluations. Table I lists the process specifications used in these evaluations.

TABLE I

| PROCESS SPECIFICATIONS | |
|---|---|
| HP Column Tray Count: | 50 |
| LP Column Tray Count: | 1–10 |
| Air Feed Tray: | Above Tray 47 |
| Recycle Feed Tray: | Below Bottom Tray |
| Heat Exchanger NTU Count: | 60–70 |
| Reboiler Delta T: | 4.35° F. |
| product GAN Specification | 5 ppm $O_2$ |
| Air Feed: | 70° F. temperature and 50% relative humidity |
| Isothermal Compression Efficiency: | 70% |
| Motor Efficiency: | 95% |
| Expander Isentropic Efficiency: | 85% |
| No expander power credit | |

The cycles shown in FIGS. 1 and 2 operate at a pressure such that the waste stream exits the main exchanger at 15 psia so that the waste vent to the atmosphere can be achieved without a loss in pressure energy. GOX product exits the sump of the LP column and leaves the main exchanger at slightly above 15 psia. There are 50 trays in the HP column and between 1 and 10 trays in the Lp column. The bottom stream from the HP column feeds the Lp column above the top tray after passing through a subcooler. The vapor leaving the top of the LP column constitutes the waste stream.

The recycled waste stream is free of $CO_2$ and $H_2O$, and therefore has no associated clean-up power (e.g., no mole sieve unit). Also, the recycle waste stream adds a separation zone at the bottom of the HP column by feeding the HP column at a point one or more trays below the air feed tray.

The recycle expander cycle of FIG. 1 expands the recycle stream to the HP column pressure. The refrigeration requirement is directly provided by adjusting the recycle compressor discharge pressure. All nitrogen is produced at the high pressure of the lower column.

The GAN expander cycle of FIG. 2 expands the GAN product stream and has the option of producing high and low pressure GAN in addition to high purity GOX. This cycle was evaluated only for the case of low pressure GAN and high purity GOX (99.5% $O_2$).

Figure 4:
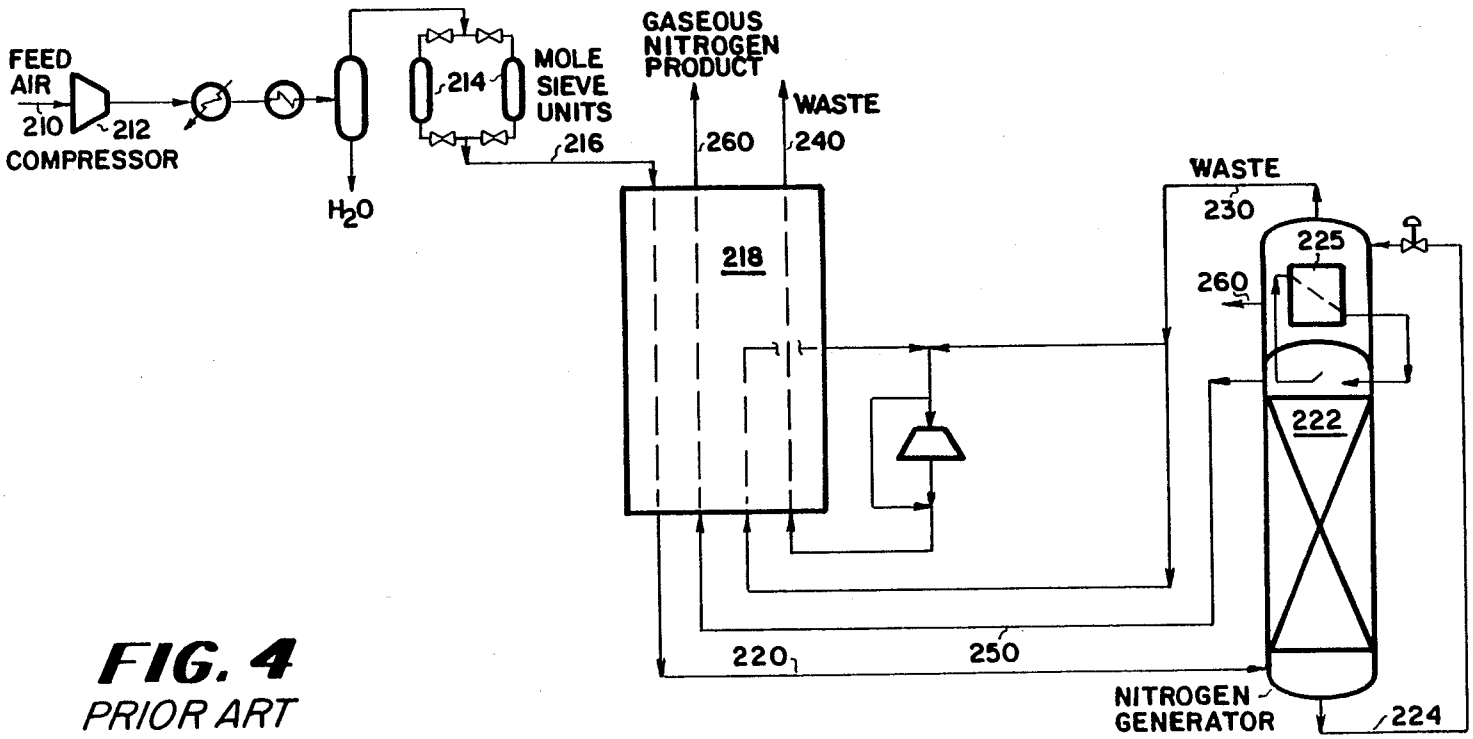
FIG. 4 PRIOR ART
FIG. 4 is a schematic diagram of a standard or conventional waste expander process for the production of nitrogen.

The double column waste recycle plant can be compared to a waste expander standard plant as shown in FIG. 4 operating with minimum expander bypass flow on the basis of product specific power. Minimum expander bypass flow is accomplished by lowering the distillation column pressure until the bypass flow vanishes, whereby the process refrigeration requirements are just met. This gives the minimum specific power for nitrogen product. The GAN product pressure datum was taken to be 115 psia, a GAN purity of 5 ppm $O_2$, and no LIN make. Therefore, GAN must be compressed to 115 psia from the pressure of the GAN product when it exits the main exchanger. The product compression power is included in the product specific power.

Table II lists the results from the above three simulations.

TABLE II

| CASE No. | LP COL TRAY COUNT | GOX PURITY (% 02) | GAN PRESSURE (psia) | GOX PRESSURE (psia) | GAN* RECOVERY (%) | GOX RECOVERY (%) | WASTE VENT FLOW (lbmol/hr) | RECYCLE FLOW (lbmol/hr) | RECYCLE $N_2$ | RECYCLE $O_2$ (%) | RECYCLE Ar | GAN SPEC. POWER at 115 psia (kwh/100 SCF) |
|---|---|---|---|---|---|---|---|---|---|---|---|---|
| | | | | | PROCESS COMPARISONS | | | | | | | |
| Recycle Expander | | | | | | | | | | | | |
| FIG. 1 | 10 | 99.5 | 71.9 | 15.5 | 69.4 | 11.5 | 19.4 | 43.6 | 47.7 | 48.2 | 4.1 | 0.554 |
| GAN Expander (all GAN is expanded): | | | | | | | | | | | | |
| FIG. 2 | 10 | 99.5 | 43.6 | 15.5 | 69.2 | 11.4 | 19.4 | 43.6 | 47.7 | 48.2 | 4.1 | 0.587 |
| Standard Plant: (Expander Bypass Flow = 0.7 lbmol/hr) | | | | | | | | | | | | |
| FIG. 3 | — | — | 66.0 | — | 47.0 | — | 52.8 | — | — | — | — | 0.541 |

*GAN Recovery (%) = 100 × (GAN/AIR)
**GOX Recovery (%) = 100 × (GOX/AIR)
Basis: Feed Air = 100 lbmol/hr As Table II shows, the better double column waste recycle process embodiment is the recycle expander embodiment of FIG. 1 which has 69.4% GAN recovery [GAN Recovery=100×(GAN/air)]and 11.5% GOX recovery [GOX Recovery=100×(GOX/air)]at 99.5% $O_2$ with a GAN specific power of 0.554 kwh/100 SCF, while the standard plant has 47.0% GAN recovery at a specific power of 0.541 kwh/100 SCF. The GOX recovery in this process is higher than that disclosed in U.S. Pat. No. 4,783,210 (approximately 7% of the air flow). Although the double column waste recycle with recycle expander process has a specific power 2.4% higher than the standard plant, this number does not include credit for GOX production.

The GAN expander embodiment of FIG. 2 has a specific power of 0.587 kwh/100 SCF—an increase of 6% over the recycle expander process. Although the GAN expander process has a higher specific power than recycle expander process, the GAN is produced at 43.6 psia with the option of also producing a high pressure GAN product.

Although this cycle has a GAN specific power 2.4% higher than the standard plant, it has the added benefit of producing high purity GOX which may be useful at some customer sites. The oxygen is produced at very low energy cost in this process. An approximate comparison may be made between the recycle expander process and a low pressure double column $N_2+O_2$ plant with $N_2$ recompression to 115 psia. For such a plant operating at 90 psia air feed pressure the specific power for nitrogen product only at 115 psia is given by

| | | |
|---|---|---|
| Air Compression | 0.317 | kwh/100 SCF $N_2$ |
| $N_2$ Compression | 0.248 | kwh/100 SCF $N_2$ |
| Mole Sieve System for Air pretreatment | 0.029 | kwh/100 SCF $N_2$ |
| Total | 0.594 | kwh/100 SCF $N_2$ |

If we assume a credit for an equivalent single column $N_2$ plant of 0.541 kwh/100 SCF, then the power attributed to the oxygen product is given by $$(0.594-0.541)\cdot 0.7/0.2=0.1855 \text{ kwh/100 SCF } O_2$$

For the new process, the oxygen separation power is given by $$(0.554-0.541)\cdot 0.694/0.115=0.0785 \text{ kwh/100 SCF } O_2$$

i.e., approximately 40% of the incremental $O_2$ power requirement in the LP $O_2$ plant.

Figure 5:
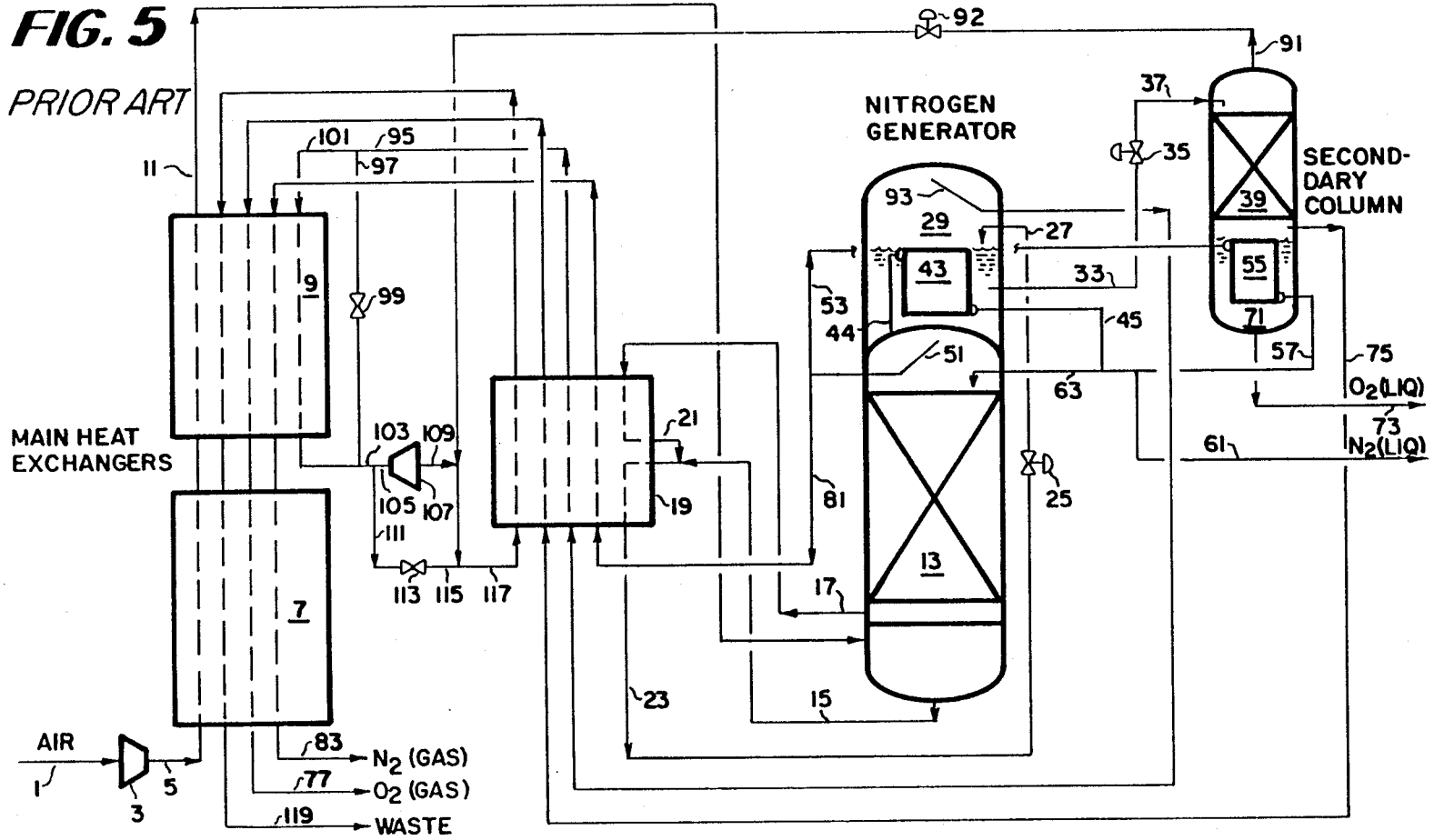
FIG. 5 PRIOR ART
FIG. 5 is a schematic diagram of a prior art process for simultaneous production of oxygen and high pressure nitrogen.

A second comparison may be made with the process of Ayres, et. al., U.S. Pat. No. 4,783,210. This process as shown in FIG. 5 has a high pressure column for nitrogen and a lower pressure column which processes a side stream of enriched oxygen from the reboiler to produce pure oxygen. In this process the product pressures for $N_2$ and $O_2$ are 124.4 psia and 30 psia, respectively, in addition there is a small production of liquid oxygen and nitrogen. Thus the calculation of the embodiment shown in FIG. 1 was revised to match these changed product conditions. The inlet pressure to the expansion turbine was increased to 155 psia to provide refrigeration for the additional liquid production. The gaseous products were compressed to match the conditions of U.S. Pat. No. 4,783,210. The power was calculated for U.S. Pat. No. 4,783,210 using the same assumptions for compression efficiency and ambient conditions as in the embodiment shown in FIG. 1. Assignment of the total power requirement to nitrogen product gave a specific power value of 0.644 kwh/100 SCF (at 124.4 psia). For the new process on the same basis the nitrogen specific power is 0.591 kwh/100 SCF. This compares to the reference power for compressed nitrogen production from a standard single column nitrogen generator (without liquid product) of 0.562 (at 124.4 psia) kwh/100 SCF. However, in this reference case there is no oxygen production. Following the same procedure as previously stated, the power attributed to oxygen production from the new process may be compared to U.S. Pat. No. 4.783,210. For the Ayres process the oxygen specific power is given by $$(0.644-0.562)\times\frac{.413}{.082}-0.413 \text{ kwh/100 SCFO}_2$$

this oxygen is produced at 30 psia

For the new process, the $O_2$ power is $$(0.591-0.562)\times\frac{.694}{.115}=0.175 \text{ kwh/100 SCFO}_2$$

Since this latter value is for 15 psia product pressure this value must be corrected to 30 psia. The corrected specific power at 30 psia is 0.259 kwh/100 SCF. It is apparent that the energy requirement for oxygen production in the process of the present invention is reduced by 37.4% compared to the Ayres et al. process. In addition, the oxygen and nitrogen recoveries are higher in the process of the present invention.

The process of the present invention has been described with reference to several specific embodiments thereof. These embodiments should not be considered as a limitation of the scope of the invention; the scope of which should be ascertained by the following claims.

We claim:

1. In a process for the separation of air into its constituent components by cryogenic distillation using a double distillation column having a high pressure column and a low pressure column, wherein a feed air stream is compressed, cooled to near to the dew point of the feed air stream, fed to the high pressure column and distilled to produce a gaseous nitrogen stream as overhead and an oxygen-enriched bottoms liquid, and wherein the oxygen-rich bottoms liquid from the high pressure column is rectified in the low pressure column producing a gaseous oxygen stream and an oxygen-enriched waste stream as overhead; the improvement for producing a high purity, high pressure, nitrogen product while simultaneously producing high purity oxygen product comprises recycling as a separate process circuit at least a portion of the oxygen-enriched waste stream removed as overhead from the low pressure column back to the bottom of the high pressure column.

2. The process of claim 1, wherein refrigeration for the process is provided by compressing and expanding at least a portion of the oxygen-enriched waste stream prior to recycle back to the bottom of the high pressure column.

3. The process of claim 1, wherein refrigeration for the process is provided by expanding at least a portion of the gaseous nitrogen stream removed as overhead from the high pressure column prior to removal from the process as product.

4. The process of claim 1, wherein refrigeration for the process is provided by further compressing and expanding at least a portion of the compressed feed air stream prior to introducing the feed air to the high pressure column.

* * * * *